US007410314B2

(12) United States Patent
Thøgersen et al.

(10) Patent No.: US 7,410,314 B2
(45) Date of Patent: Aug. 12, 2008

(54) APPARATUS FOR RECEIVING INVERTING AND RETURNING SHEETS FROM AND TO A PRINTER FOR LARGE-SIZED PAPER

(75) Inventors: Klaus Thøgersen, Charlottenlund (DK); Christoffer Bay, Holte (DK)

(73) Assignee: Teknologi & Produkt Udvikling A/S, Holte (DK)

( * ) Notice: Subject to any disclaimer, the term of this patent is extended or adjusted under 35 U.S.C. 154(b) by 1126 days.

(21) Appl. No.: 10/472,079

(22) PCT Filed: Mar. 13, 2002

(86) PCT No.: PCT/DK02/00168

§ 371 (c)(1),
(2), (4) Date: Sep. 12, 2003

(87) PCT Pub. No.: WO02/072458

PCT Pub. Date: Sep. 19, 2002

(65) Prior Publication Data

US 2004/0046312 A1 Mar. 11, 2004

(30) Foreign Application Priority Data

Mar. 14, 2001 (DK) ..... 2001 00433

(51) Int. Cl.
*B41J 11/00* (2006.01)

(52) U.S. Cl. ..... 400/621; 271/185; 271/186; 101/222; 101/225; 101/226; 101/223; 101/224; 347/157

(58) Field of Classification Search ..... 400/621; 271/291, 184, 185, 186; 101/230, 231, 222, 101/223, 224, 226, 225, 257; 347/157
See application file for complete search history.

(56) References Cited

U.S. PATENT DOCUMENTS 4,019,435 A 4/1977 Davis ..... 101/232

(Continued)

FOREIGN PATENT DOCUMENTS

WO WO0179097 10/2001

*Primary Examiner*—Ren Yan
*Assistant Examiner*—Matthew G Marini
(74) *Attorney, Agent, or Firm*—Cooper & Dunham LLP

(57) ABSTRACT

An apparatus for receiving, inverting and returning sheets from and to a printer for large-sized paper, said printer being adapted to be automatically fed a web of paper from a supply of paper through an inlet (6), defined by a portion of a paper-supporting plate (7), where said printer further is adapted to print and cut sheets of said web of paper and to guide the printed sheet out thereof through a separate outlet (13), where the apparatus is adapted to receive the just printed and cut sheets from said outlet and to return said sheets to the printer in the inverted state. The apparatus comprises a rotatable first guide means (14), which in one position guides the sheet into the apparatus and in a second position guides said sheet past the apparatus. The apparatus comprises furthermore a first driving roller means (36) and a second guide means (21) pivotally arranged relative to said roller means, where the second guide means (21) in a first position guides the sheet advanced to the apparatus round the first roller means (36) during the initial movement of the sheet into the apparatus, and where said second guide means (21) in a second position presses said sheet into a driving engagement with the first driving roller means (36) in such a manner that said first driving roller means (36) takes over the driving of the sheet both during the remaining movement of said sheet inside the apparatus as well as during the movement of said sheet out of said apparatus again and into the printer through the inlet (7) of said printer while the direction of rotation is inverted. The apparatus comprises also a second driving roller means (46) adapted to engage the portion of the web of paper (60) being left on the paper-supporting plate (7) after the sheet has been cut off and to pull said portion temporarily backwards in such a manner towards the paper supply (61) while the sheet is being inverted that said sheet can be guided into the printer without colliding with the web of paper.

10 Claims, 19 Drawing Sheets

U.S. PATENT DOCUMENTS 4,191,369 A * 3/1980 Matsuda et al. ..... 271/299
4,412,740 A * 11/1983 Buddendeck et al. ..... 399/374
4,623,900 A 11/1986 Watanabe ..... 346/76 PH
4,925,178 A * 5/1990 Clabbers et al. ..... 271/186
4,962,386 A * 10/1990 Hakkaku et al. ..... 347/232
6,018,640 A * 1/2000 Blackman et al. ..... 399/364
6,290,410 B1 * 9/2001 Sunada et al. ..... 400/624
6,371,481 B1 * 4/2002 Miyake ..... 271/314
6,575,455 B2 * 6/2003 Thøgersen et al. ..... 271/186
6,674,035 B2 * 1/2004 Ito ..... 209/563
6,705,786 B2 * 3/2004 Trovinger ..... 400/645.3
6,729,780 B2 * 5/2004 Sampson et al. ..... 400/74

* cited by examiner

APPARATUS FOR RECEIVING INVERTING AND RETURNING SHEETS FROM AND TO A PRINTER FOR LARGE-SIZED PAPER

TECHNICAL FIELD

The invention relates to an apparatus for receiving, inverting and returning sheets from and to a printer for large-sized paper, said printer being adapted to be automatically fed a web of paper from a supply of paper through an inlet defined by a portion of a paper-supporting plate, where said printer further is adapted to print and cut sheets of said web of paper and to guide the printed sheet out thereof through a separate outlet, where the apparatus is adapted to receive the just printed and cut sheets from said outlet and to return said sheets to the printer in the inverted state, said apparatus comprising a pivoting first guide means which in one position guides the sheet into the apparatus and in a second position guides said sheet past said apparatus.

BACKGROUND ART

Various printers for large-sized paper are known. Such printers are primarily used for printing on one side of the paper, and they are often used for the production of samples of for instance posters and the like articles before the final printing is initiated. The paper is available in form of separate sheets fed manually into the printer or it is available in form of rolls. After the printing procedure, the paper usually falls into a tray or basket arranged below the printer, said tray or basket being secured to the support of the printer. Some printers, such as the type sold under the trade name HP DesignJet-1000-series are fed the paper of a size of up to approximately 1 m, said paper usually being in form of a web of paper from a roll guided into the printer through a suitable inlet and cut therein in lengths varying according to desire. After the printing procedure, the sheet is guided through a separate outlet. Such printers are also adapted to handle separate sheets. These separate sheets are guided manually into the printer through the separate outlet. Other printers, such as the type sold under the trade name HP DesignJet-5000-series are adapted to receive paper of a size of 1 to 1.6 m in form of webs of paper from rolls, said paper being guided into the printer through a suitable inlet and cut therein in lengths varying according to desire. After the printing procedure, the material is guided through a separate outlet and falls usually into a tray or basket arranged below the printer, said tray or basket being secured to the support of the printer. These printers are not adapted to a manual feeding of sheets through the separate outlet. A manual feeding of such printers must be carried out through the same inlet as the one used for the feeding of the web of paper.

Sometimes printing on both sides is required, and then it is necessary to invert the paper. However, it is not possible to guide a sheet manually through the inlet without retracting the web of paper first. When an automated printing on both sides of the paper is desired, it is therefore necessary to employ a sheet inverter allowing an automated inverting of the sheet of paper and an automated returning of said paper to the inlet while a retention of said web of paper is maintained.

BRIEF DESCRIPTION OF THE INVENTION

The object of the invention is to provide an apparatus capable of initiating such an automated inverting and returning of sheets of paper to the inlet of the printer while a retention of said web of paper is maintained.

The apparatus according to the invention is characterised in that it comprises a first driving roller means and a second guide means pivotally arranged relative to said roller means, where the second guide means in a first position guides the sheet advanced to the apparatus round the first roller means during the initial movement of the sheet into the apparatus, and where said second guide means in a second position presses said sheet into a driving engagement with the first driving roller means in such a manner that said first driving roller means takes over the driving of the sheet both during the remaining movement of said sheet inside the apparatus as well as during the movement of said sheet out of said apparatus again and into the printer through the inlet of said printer while the direction of rotation is inverted, and that the apparatus comprises a second driving roller means adapted to engage the portion of the web of paper being left on the paper-supporting plate after the sheet has been cut off and to pull said portion temporarily backwards in such a manner towards the paper supply while the sheet is being inverted that said sheet can be guided into the printer without colliding with the web of paper.

As a result an apparatus is obtained which is able to receive the sheet and to guide said sheet into the apparatus so as not until at a later stage to subject said sheet to a squeezing engagement whereby the just printed sheet is allowed to dry. In addition, the apparatus is capable of removing the remaining portion of the web of paper from the inlet in such a manner that after being inverted the sheet can freely be guided into the printer and to the location where the advancing mechanisms of the printer can take over the advancing of said sheet. The position of the first guide means determines whether the sheet is to be subjected to an inverting procedure or to be merely guided directly into a tray or a basket below the printer. When the sheet is to be printed on one side only, the first guide means ensures that no inverting is initiated. When the sheet is to be printed on both sides, the first guide means guides the sheet into the apparatus, and after the inverting and printing on the second side of the sheet said first guide means ensures that said sheet is guided directly from the outlet of the printer, round the apparatus and into a tray or basket arranged below the printer.

According to the invention, the second guide means may comprise an idler roller means enabling the second guide means to press the sheet in question against the first driving roller means, said idler roller means being biased in such a manner that it is pressed against said roller means by a biasing. As a result, the advancing of the sheet while squeezed between the idler roller means and the first driving roller means can be carried out in an exact and controlled manner with the effect that suitable sensors and measuring equipment can control the positioning and alignment of the sheet during the inverting procedure.

Furthermore, the second guide means may according to the invention comprise a catching slot for catching the front end of a sheet from the outlet of the printer, whereby a reliable catching and a good guiding of the sheet are obtained.

Moreover, the apparatus may according to the invention be characterised in that the catching slot is defined by a first and a second guide rod, said guide rods being substantially parallel and supported at each end by their respective arms which are pivotally journalled about an axis of rotation extending parallel to said guide rods and to the axis of rotation of the first roller means, where said first-mentioned axis of rotation forms the axis of rotation about which the second guide means is rotating, and that the guide rods comprise their respective slot-defining surfaces which oppose one another on their respective sides of a guide plane which includes the axis of rotation of the arms and extends substantially freely through the catching slot, and that said guide plane in the first position of the second guide means extends obliquely upwards towards the outlet of the printer from the axis of rotation of the arms and substantially tangential to the first driving roller means, said latter axis of rotation being positioned on the side of the first driving roller means which opposes the printer and is on the level of the lower side of the first driving roller means, and that said guide plane intersects the first driving roller means in the second position of the second guide means. As a result, the sheet can be guided during the initial introduction into the apparatus in a simple manner past the first driving roller means and subsequently automatically be arranged in a path extending across a portion of the surface of the roller means.

According to the invention, the idler roller means may be positioned on the same side as the first guide rod when seen relative to the above guide plane, relative to which said first guide rod is placed on the side opposite the axis of rotation of the first roller means when the second guide means is in its first position, said idler roller means also being positioned at a larger distance from said guide plane than the adjacent area of the slot-defining surface of the adjacent guide rod, and where the slot-defining surface of the second guide rod comprises an edge placed close to the axis of rotation of the second guide means, said edge being positioned at a larger distance from said axis of rotation than the corresponding edge on the first guide rod. As a result, the rearmost end of the sheet is automatically pressed downwards against the surface of the first roller means in the second position of the second guide means when said rearmost end is in the area surrounding the edge on the first guide rod closest to the first roller means and outside the area of the corresponding edge on the second guide rod. In this manner a reliable guiding is ensured of the end in question of the sheet past the second guide rod when said sheet with this end in front is returned to and moved into the printer by means of the first roller means.

According to the invention it is particularly advantageous when the width of the catching slot increases in a direction radially away from the associated axis of rotation, whereby the angle between the planes being tangent to the slot-defining surfaces and said guide plane increases in said direction and mostly along the surface of the second rod.

According to the invention a sheet-supporting plate may be provided on each side of the engaging area between the idler roller means and the first roller means, said sheet-supporting plate extending to an area adjacent the paper-supporting plate of the printer on the side of the second driving roller means which is positioned adjacent the printer inlet. In this manner it is ensured that the sheet is guided efficiently round the first roller means during the feeding into the apparatus and subsequently back to the printer inlet during the subsequent movement.

Furthermore, the second driving roller means may according to the invention comprise a plurality of rollers, where each roller is rotatably arranged about a shaft supported at one end by a pair of supporting arms which in turn are rotatably arranged at the opposite end about an axis of rotation common to all the supporting arms in such a manner that the rollers can swing to and fro in a direction away from the paper-supporting plate, said rollers being supported and subjected to a biasing force in a direction towards said paper-supporting plate. As a result, an efficient driving is ensured of the portion of the paper web at the inlet both away from the printer and into the printer again.

According to the invention, the rollers may advantageously be driven by means of belt drives comprising their respective driving pulleys, which are arranged coaxially to the common axis of rotation of the supporting arms and which are driven by means of a common actuating means, said belt drives further comprising a driven pulley fixedly connected to the roller in question. The resulting load and driving of the rollers is uniform across the entire width of the web of paper independent of the angular position of the supporting arms. Finally, a release means may according to the invention be provided which is adapted to simultaneously move all the rollers away from the paper-supporting plate. As a result, a new web of paper can be fed to the printer by passing between the rollers and the paper-supporting plate.

BRIEF DESCRIPTION OF THE DRAWINGS

The invention is explained in greater detail below with reference to the accompanying drawings, in which.

BEST MODE FOR CARRYING OUT THE INVENTION

Figure 1:
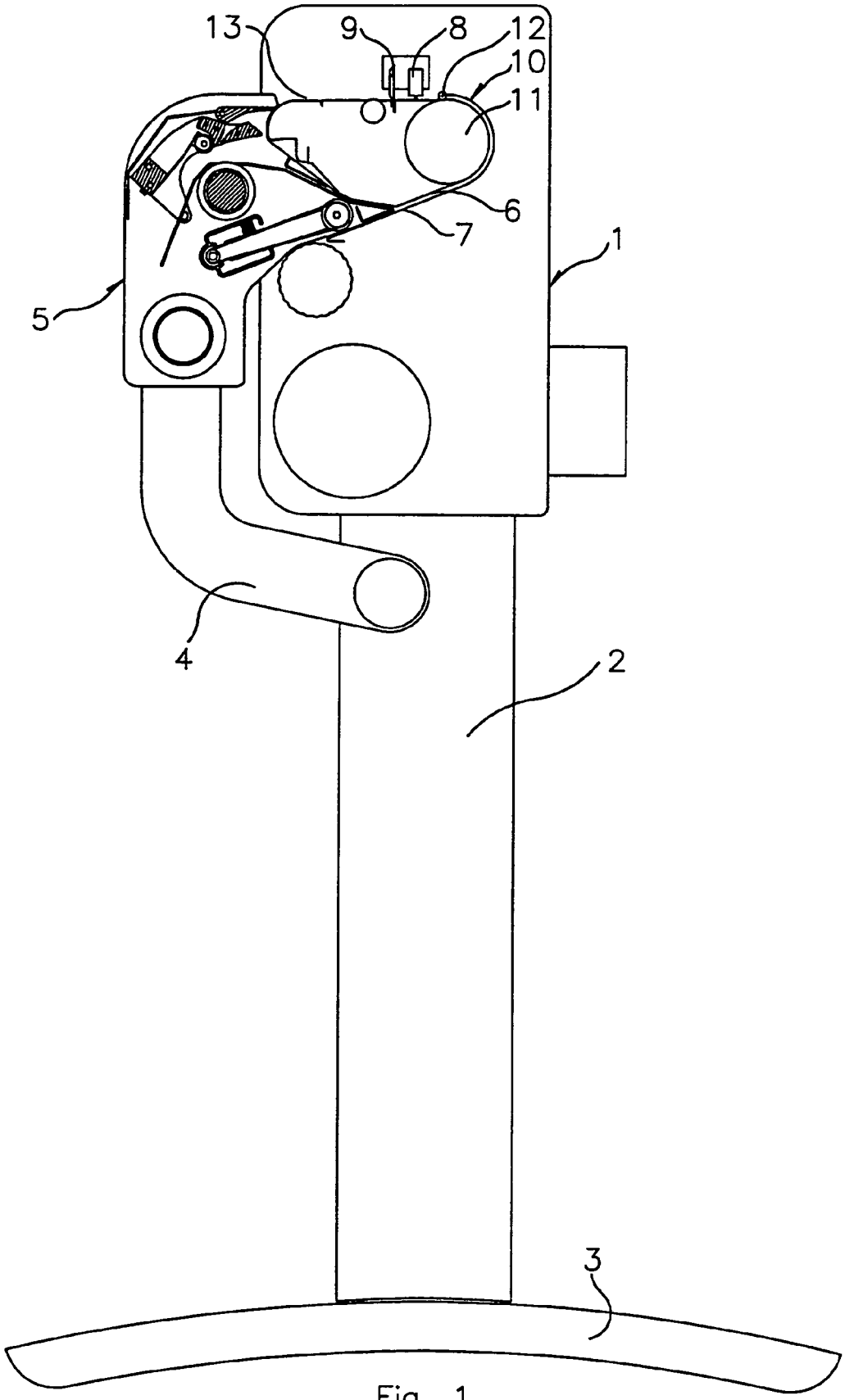
FIG. 1 is a diagrammatic side view of a printer with an apparatus according to the invention, where parts have been removed for the sake of clarity.

FIG. 1 illustrates a printer designated the general reference numeral 1 and comprising a support 2 with a base 3. An apparatus according to the invention for inverting a sheet of paper from the printer is secured at the support 2 through a connection with two bent arms 4. This apparatus is designated the general reference numeral 5. The printer 1 is of a conventionally known type corresponding to the above HP Design-Jet-5000-series comprising an oblong slot 6 which forms an inlet to the printer and which downwardly is defined by a paper-supporting plate 7. The paper-supporting plate 7 extends to a printing means 8 and a cutting device 9 as well as advancing mechanisms designated the general reference numeral 10. These advancing mechanisms comprise co-acting pairs of rollers 11 and 12 and vacuum sources. Together the rollers 11 and 12 and the vacuum sources can ensure a correct alignment and retention of the webs and sheets of paper to be printed and cut off. The web/the sheets of paper leave the printer through an outlet shown at the reference numeral 13.

Figure 5:
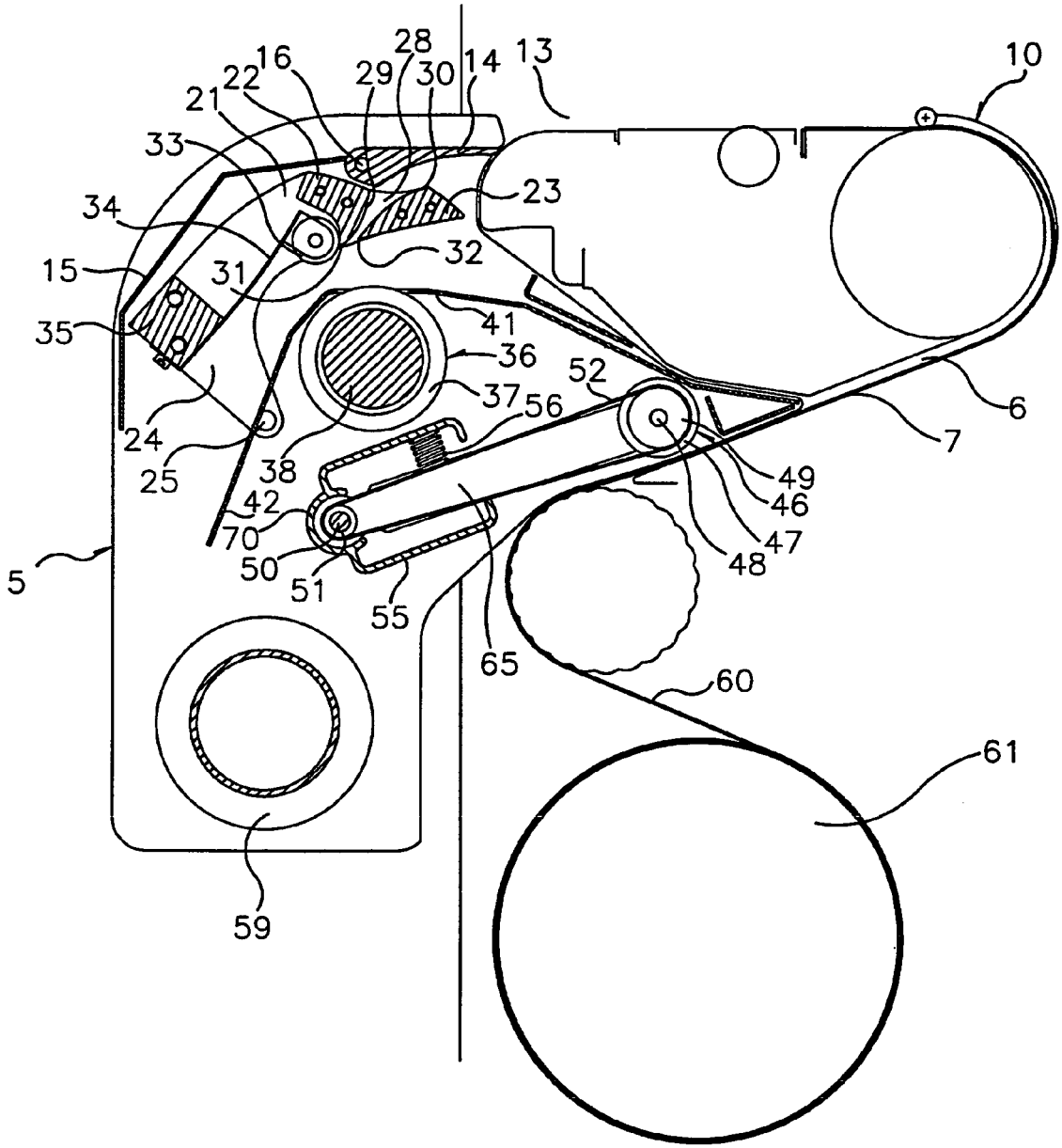

The apparatus according to the invention is dimensioned and arranged such that it can co-operate both with the inlet 6 and the outlet 13 of the printer. The apparatus comprises a first guide means 14 arranged in a slot between a covering shield 15 on the apparatus and adjacent portions of the printer at the outlet 13 of said printer, which has been clearly illustrated inter alia in FIG. 2. The first guide means 15 is shaped as an elongated flap hingedly arranged at one end of a shaft 16. At one end of the apparatus, this shaft 16 is connected to a cam follower 17, cf. FIG. 3, which co-operates with a cam disk 18 driven by means of a motor 19. Therefore the first guide means 14 operates in two positions, viz. a first position in which the slot into the apparatus is open and the flap presents such an inclination relative to the printer outlet that a front end 20 of a web or a sheet of paper can be directed downwards into the interior of the apparatus 5, cf. for instance FIG. 5; and a second position in which the slot into the apparatus 5 is closed, cf. FIG. 2, with the result that sheets or webs of paper leaving the printer are moved round said apparatus 5.

Figure 3:
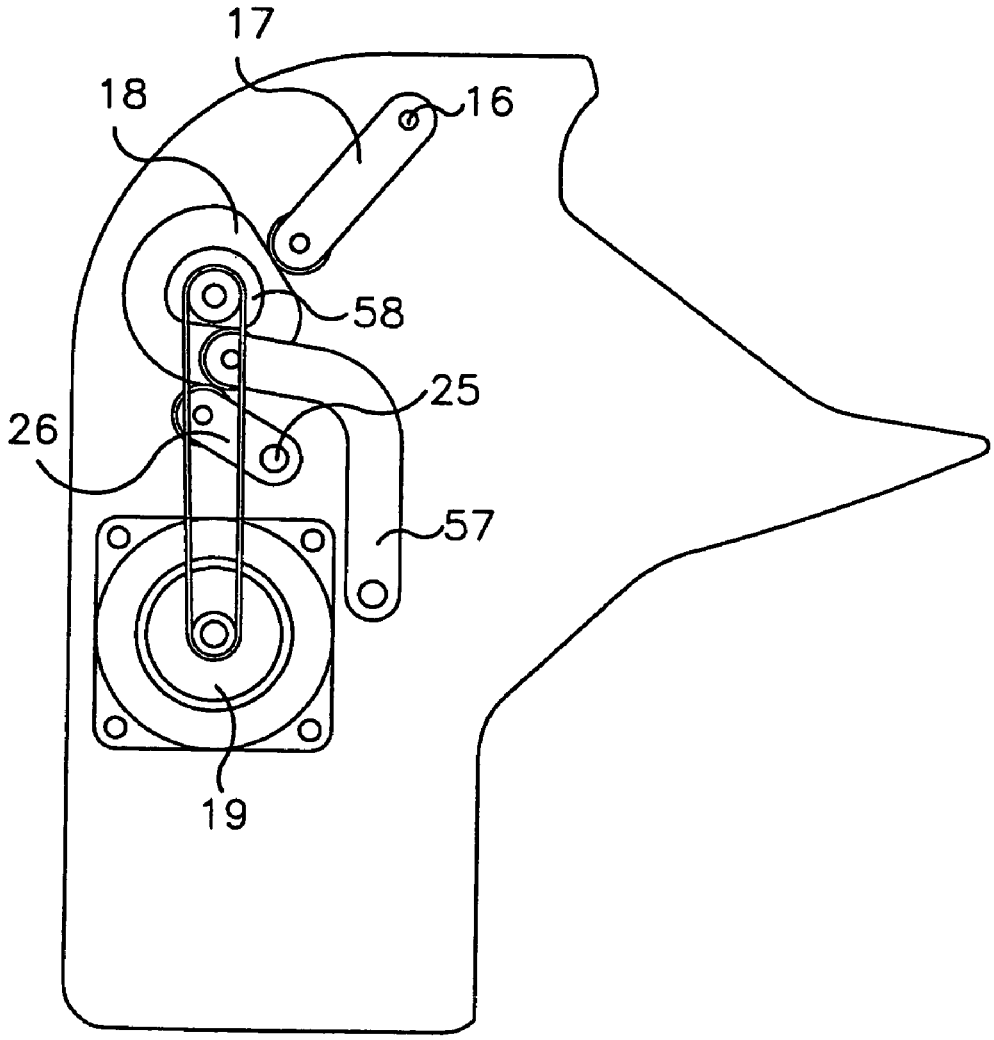
FIG. 3 illustrates one end of the apparatus.

A second guide means 21 is provided immediately inside the slot at the first guide means 14. The second guide means 21 comprises two guide rods 22, 23. At each end these guide rods are supported by an arm 24, only one of said arms being shown in the drawings. These arms 24 are supported by a shaft 25 which at one end of the apparatus, cf. FIG. 3, is connected to a cam follower 26 also co-operating with the above cam disk 18.

Figure 2:
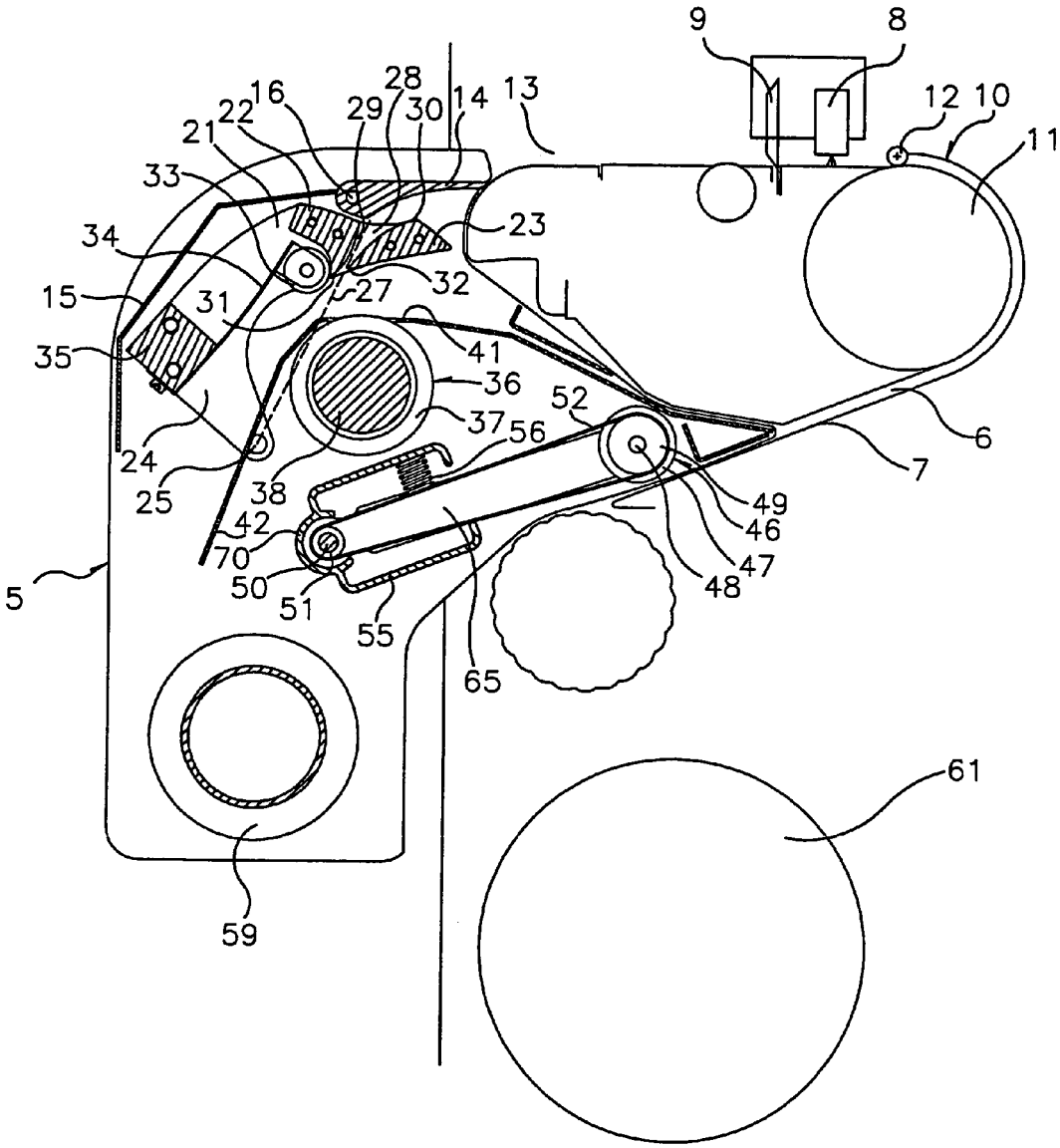
FIG. 2 illustrates on a larger scale a diagrammatic cross sectional view of parts of the apparatus according to the invention and associated parts of the printer.

The guide rods 22 are arranged on their respective sides of a guide plane 27 indicated by means of dotted lines in FIG. 2. The guide plane includes the axis of rotation of the shaft 25 and extends through a slot 28 between the guide rods 22 and 23. This slot serves to catch the front end 20 of a web of paper moved from the printer and into the apparatus 5. The guide rods 22 and 23 comprise a surface 29 and 30, respectively, facing the slot and interspaced a distance increasing in a direction away from the shaft 25. Besides the guide rods 22 and 23 are arranged parallel to one another and shaped as section rods. The angle between the guide plane 27 and the tangential planes of the above surfaces increases in the described direction away from the shaft 25. However, the surface 29 of the guide rod 22 positioned in the area closest to the end of said shaft 25 presents such a course that the angle of said tangential planes relative to the guide plane 27 starts to decrease as a function of the distance from the shaft 25. The angle between the guide plane 27 and the tangential planes of the surface 30 of the second guide rod 23 increases substantially continuously across the entire slot area as function of the distance from the shaft 25. As illustrated in FIG. 2, the edge 31 of the surface 29 on the guide rod 22 is closer to the shaft 25 than the corresponding edge 32 on the second guide rod 23, said first-mentioned edge 31 being positioned adjacent the shaft 25.

In addition, the second guide means 21 comprises a number of idler rollers 33 supported by their respective spring blade 34 on a rod 35 secured to the arms 24. These idler rollers 33 are arranged closer to the shaft 25 than the guide rods 22 and 23 and on the same same of said guide plane 27 as the guide rod 22.

Figure 4:
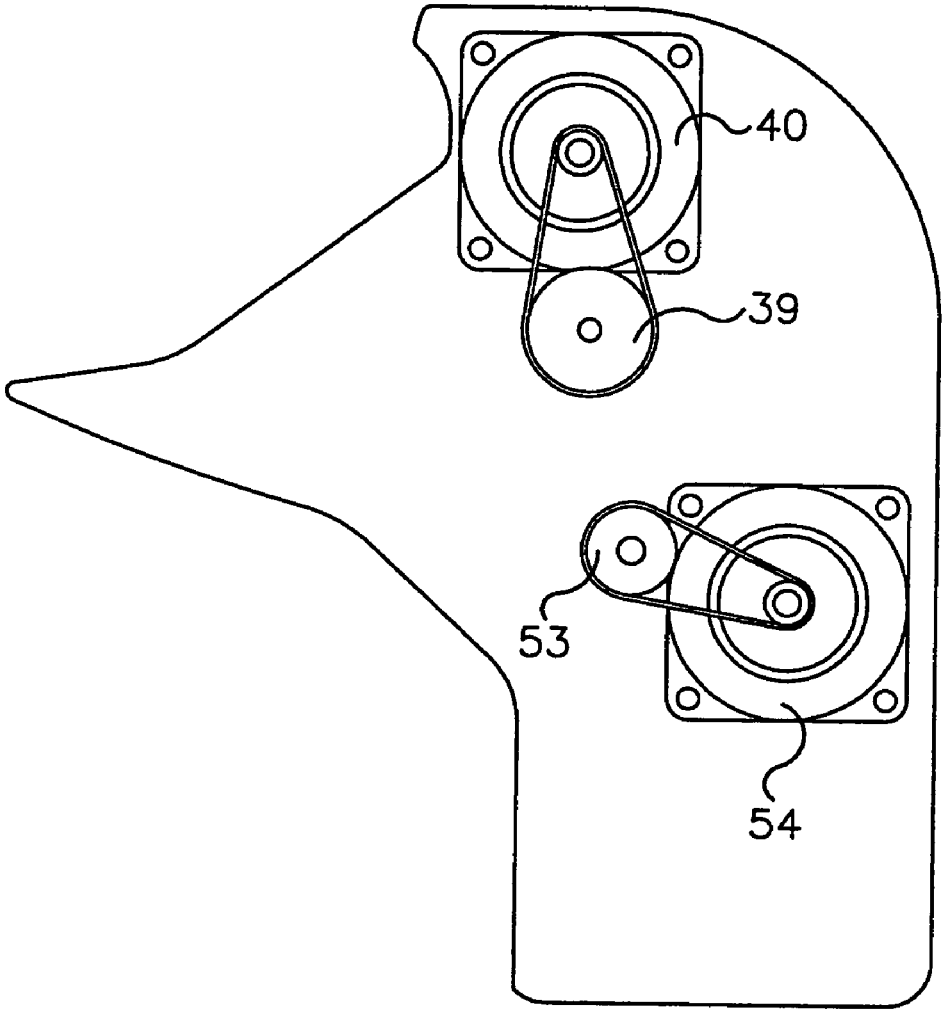
FIG. 4 illustrates the opposite end of the apparatus, FIG. 5 corresponds to FIG. 2, but with a web of paper fed from a roll and into the printer to the cutting and printing area, FIG. 6 corresponds to FIG. 2, but where the apparatus is in the state where it is ready to receive a sheet to be inverted, FIG. 7 corresponds to FIG. 6, but where the web of paper has been advanced during the printing through the printer and is about to enter the apparatus according to the invention, FIG. 8 corresponds to FIG. 6, but where the front end of the web of paper has been moved into the apparatus according to the invention, FIG. 9 corresponds to FIG. 6, but where the sheet inside the apparatus is squeezed between a second guide means and a first driving roller means, FIG. 10 corresponds to FIG. 9, but showing the cutting device of the printer cutting the web of paper and accordingly cutting a sheet, FIG. 11 corresponds to FIG. 10, but where the sheet has been moved a distance further into the apparatus according to the invention, and where the end now in front of the web of paper is about to be pulled backwards in a direction towards the supply roll and the outlet of the printer, FIG. 12 corresponds to FIG. 11, but where the sheet has been moved as far into the apparatus as possible and is ready to be returned to the printer while the front end of the web of paper is retained in an area outside the inlet of the printer, FIG. 13 corresponds to FIG. 12, but where the sheet has been moved so far back into the printer that its front end is ready to be handled by the advancing mechanisms of the printer, FIG. 14 corresponds to FIG. 13, but where the sheet passes through the printer and is about to be printed on the back while the first guide means is moved into a position in which the inlet of the apparatus according to the invention is blocked, whereas the second guide means is moved into a first position in which it is ready to receive a new sheet optionally to be inverted, FIG. 15 corresponds to FIG. 14, but where the front end of the web of paper is moving into the printer and the just printed sheet has been moved away, FIG. 16 corresponds to FIG. 15, but where the web of paper has been moved so far forwards that the advancing mechanisms of the printer have taken over the advancing and the second driving roller means of the apparatus has disengaged said web of paper.

The second guide means 21 is arranged in connection with a first driving roller means designated the general reference numeral 36. This first driving roller means comprises a plurality of rubber rings 37 secured on a shaft 38 which at the end is connected to a pulley 39, cf. FIG. 4, driven by means of a motor 40. An upper portion of the rubber rings 37 project through a slot or their respective slots 41 in a guide plate 42. To the left of the roller means 36 in FIG. 2, the guide plate 42 presents a downwardly inclining course. To the right in FIG. 2, this guide plate 42 also inclines downwards with a number of bends, but towards the printer inlet 6. The second guide means 21 operates in two positions determined by the cam disk 18. In one position, cf. FIG. 2, the guide means is in a position far away from the driving roller means 36 and in such a manner that the slot 28 between the guide rods 22, 23 are able to catch the front end 20 of a web or a sheet of paper being directed into the apparatus by means of the first guide means 14. In the second position, the second guide means is turned downwards towards the roller means 36 by being turned clockwise relative to FIG. 2 until the idler rollers 33 abut the upwardly projecting portions of the rubber rings 37 on the roller means 36, cf. for instance FIG. 9. The second guide means 21 is dimensioned such that the idler rollers 33 abut the rubber rings 37 by means of a predetermined biasing caused by the flat springs 34 while the adjacent edge 31 on the guide rod 22 is simultaneously positioned a short distance away from said rubber rings 37. In addition, the guide rod 23 is dimensioned such that it forms a slot together with the guide plate 42 in this second position. As illustrated inter alia in FIG. 9, this slot continues into an additional slot 44 which is defined between the above guide plate 42 and an additional guide plate 45.

A second driving roller means designated the general reference numeral 46 is provided inside the apparatus 5. This second driving roller means 46 comprises a plurality of rubber-coated rollers 47. Each roller 47 is rotatably arranged on a shaft 48 and fixedly connected to a pulley 49. The shafts 48 are supported by supporting arms 65 which are pivotally journalled in a bearing 70 forming part of a release means 55. In addition, the supporting arms support a shaft 50 coaxially arranged relative to the bearing 70 of the release means 55. This shaft 50 is fixedly connected to a pulley 51 corresponding to each pulley 49, and each pulley 51 is connected to a corresponding pulley 49 by means of a belt 52. At one end the shaft 50 is furthermore connected to a pulley 53 driven by means of a motor 54, cf. FIG. 4.

The above release means 55 is a U-shaped profile member pivotally journalled at the ends. Centrally the release means forms the above bearing 70 which presents a C-shaped cross section and supports a spring 56 associated with each roller 47. The spring 56 co-operates with the associated supporting arms 49 and subject the rollers to a biasing in a downward direction towards the paper-supporting plate 7 when the release means 55 is turned clockwise and downwards into a suitable position. The latter position is also determined by means of a cam follower 57 which is connected to the release means 55 at one end, cf. FIG. 3, and co-operates with a separate cam disk 58. When the release means 55 is moved counterclockwise, the rollers 47 are displaced so as to disengage the paper-supporting plate 7, cf. FIG. 2.

As illustrated in FIG. 3, both cam disks 18 and 58 are driven by the motor 19, and accordingly the first guide means 14, the second guide means 21 and the rollers 47 are moved synchronously.

An additional guide roller 59 is provided inside the apparatus 5, and this guide roller can be fixedly arranged or be arranged so as to be freely rolling according to desire. Finally, the paper-supporting plate 7 can be provided with a Teflon-coating in order to minimize the surface friction.

Figure 6:
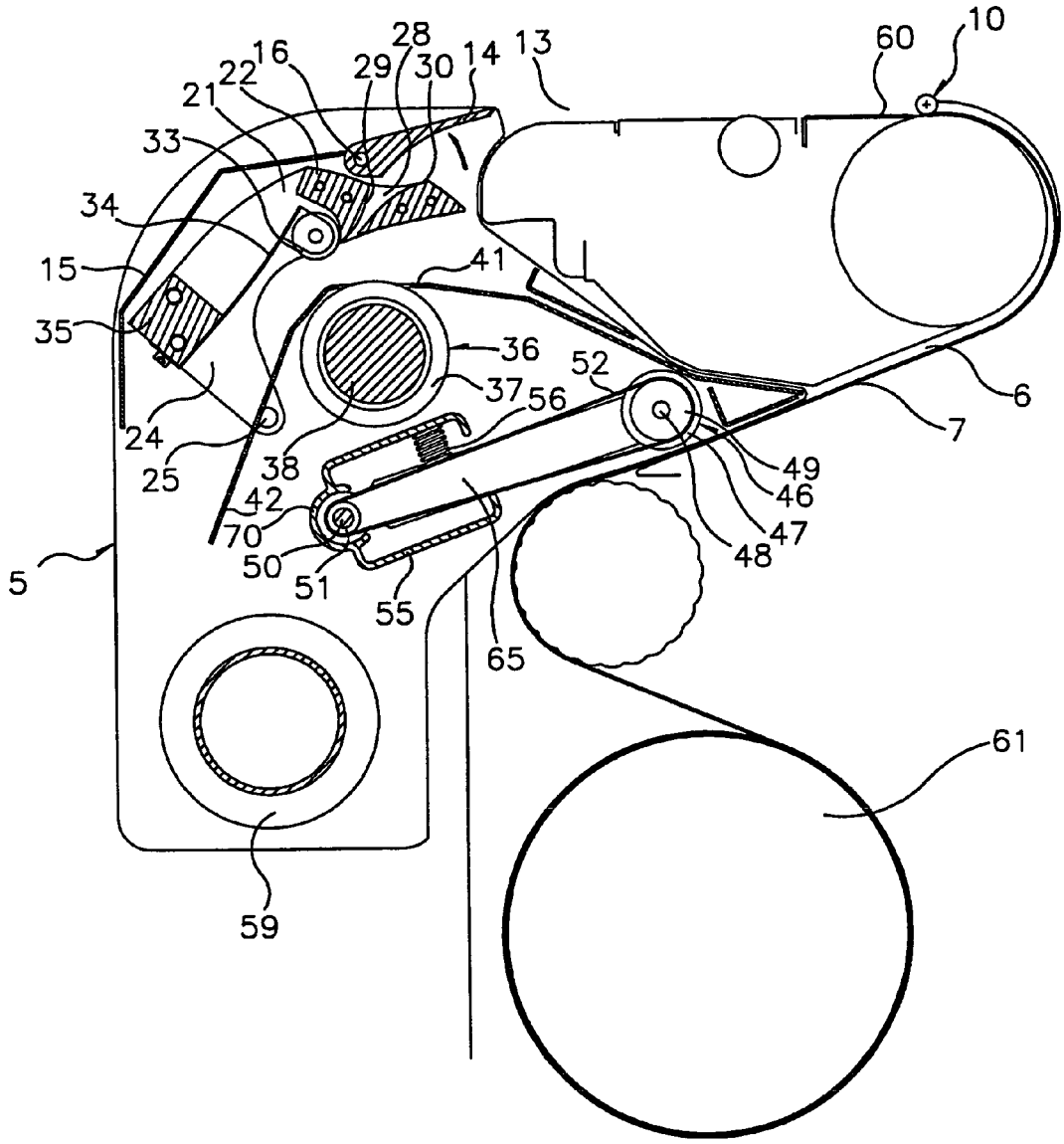
Figure 7:
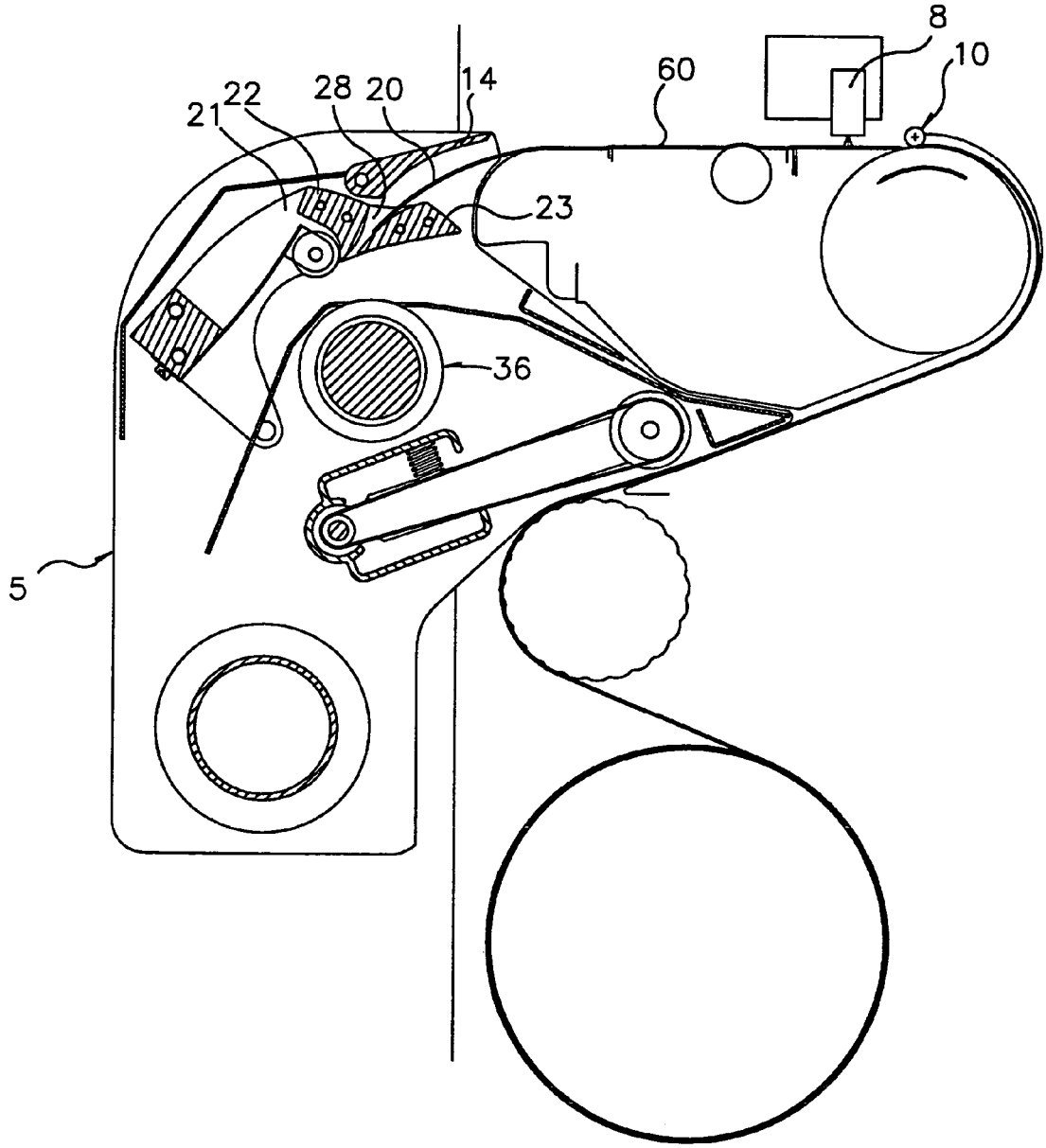

When the printer 1 with the apparatus 5 according to the invention is used, a web of paper 60 is initially fed from a roll 61 of paper into and through the inlet 6 and forward to the advancing mechanisms 10 of the printer. This feeding is carried out manually. Subsequently, the advancing mechanisms 10 of the printer take over the advancing and initiate an aligning and cutting procedure in such a manner that the web is completely ready and the printing procedure can be started, cf. FIG. 5. When the printer is to be used for a printing on both sides, the first guide means 14 is initially caused to enter the upper open position, cf. FIG. 6. At the same time the second guide means 21 enters the upper position shown in FIG. 6, viz. at a large distance from the contact with the first driving roller means 36. Such a positioning of both the first guide means 14 and the second guide means 21 is carried out by means of the guide mechanism comprising the cam disk 18, cf. the above description. As the printing procedure is carried out by means of the printing means 8, the front end 20 of the web 60 of paper or of the first sheet not yet cut off is guided into the apparatus through the slot below the first guide means 14 and through the slot 28 defined by the guide rods 22 and 23 in the second guide means 21.

As the second guide means 21 is moved into a position in which it disengages the first driving roller means 36, said positioning has the effect that the web of paper 60 can pass into the apparatus without being subjected to a pull inside said apparatus. The advancing is exclusively carried out by means of the advancing mechanism 10 of the printer. The just printed surface of the web of paper 60 can simultaneously pass into the apparatus without being touched by any parts of said apparatus, and accordingly the just printed image or the like print is allowed to dry.

Figure 8:
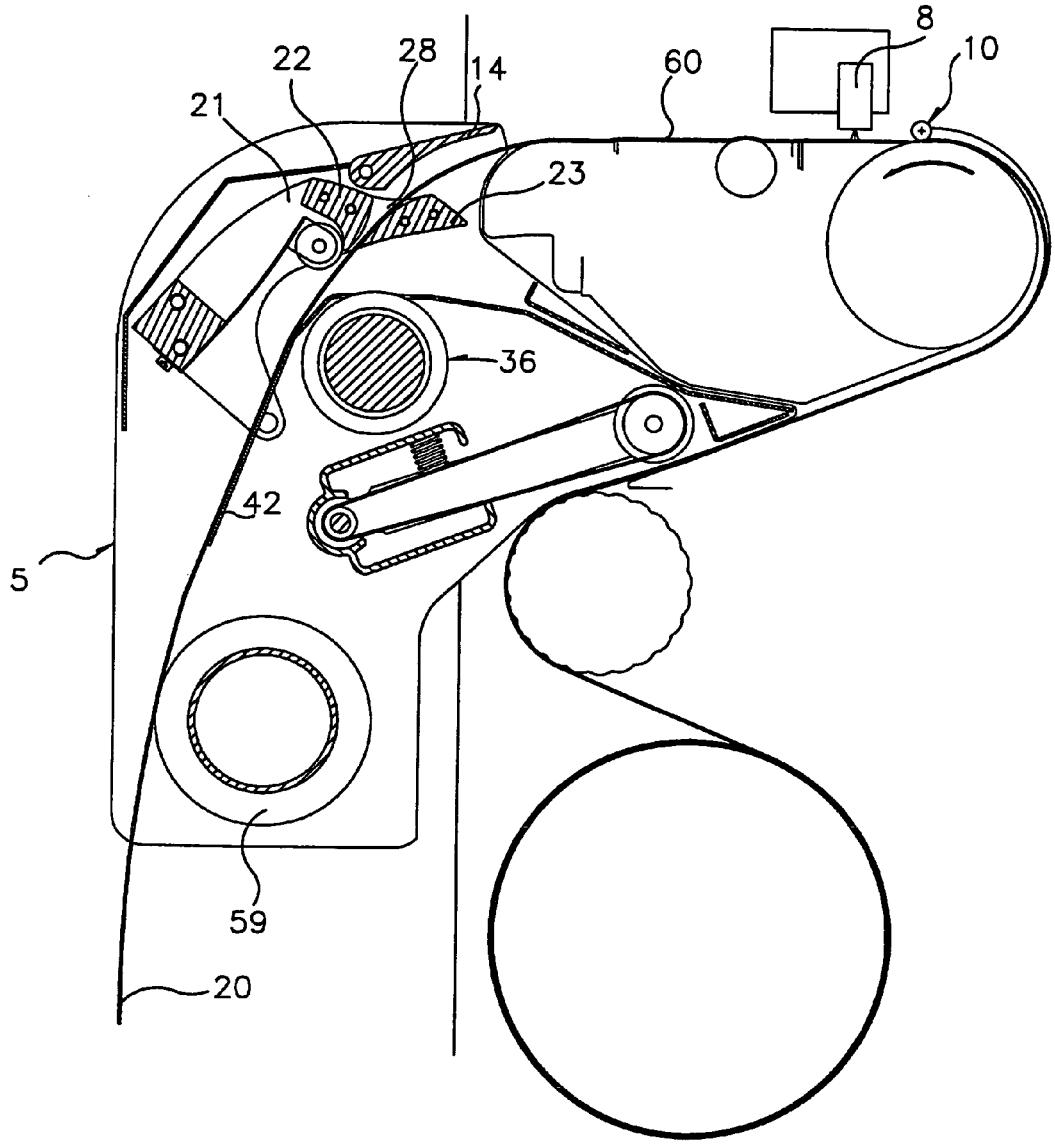

The advancing of the web of paper 60 continues, cf. FIG. 8, by the front end 20 passing across the guide plate 42 and the guide roller 59. Thus the apparatus 5 renders it possible to handle sheets to be inverted while said sheets are ensured a prolonged drying period.

Figure 9:
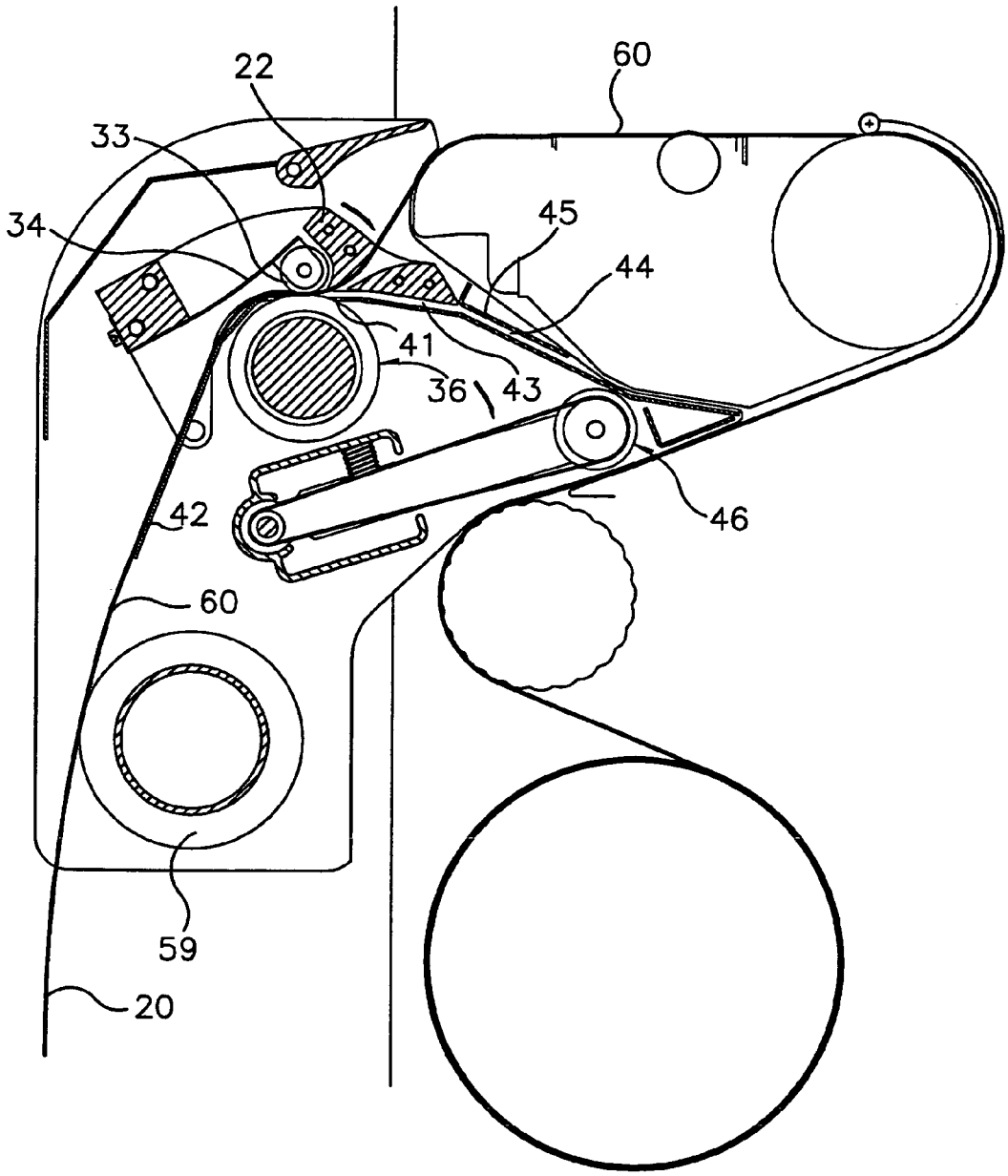
Figure 10:
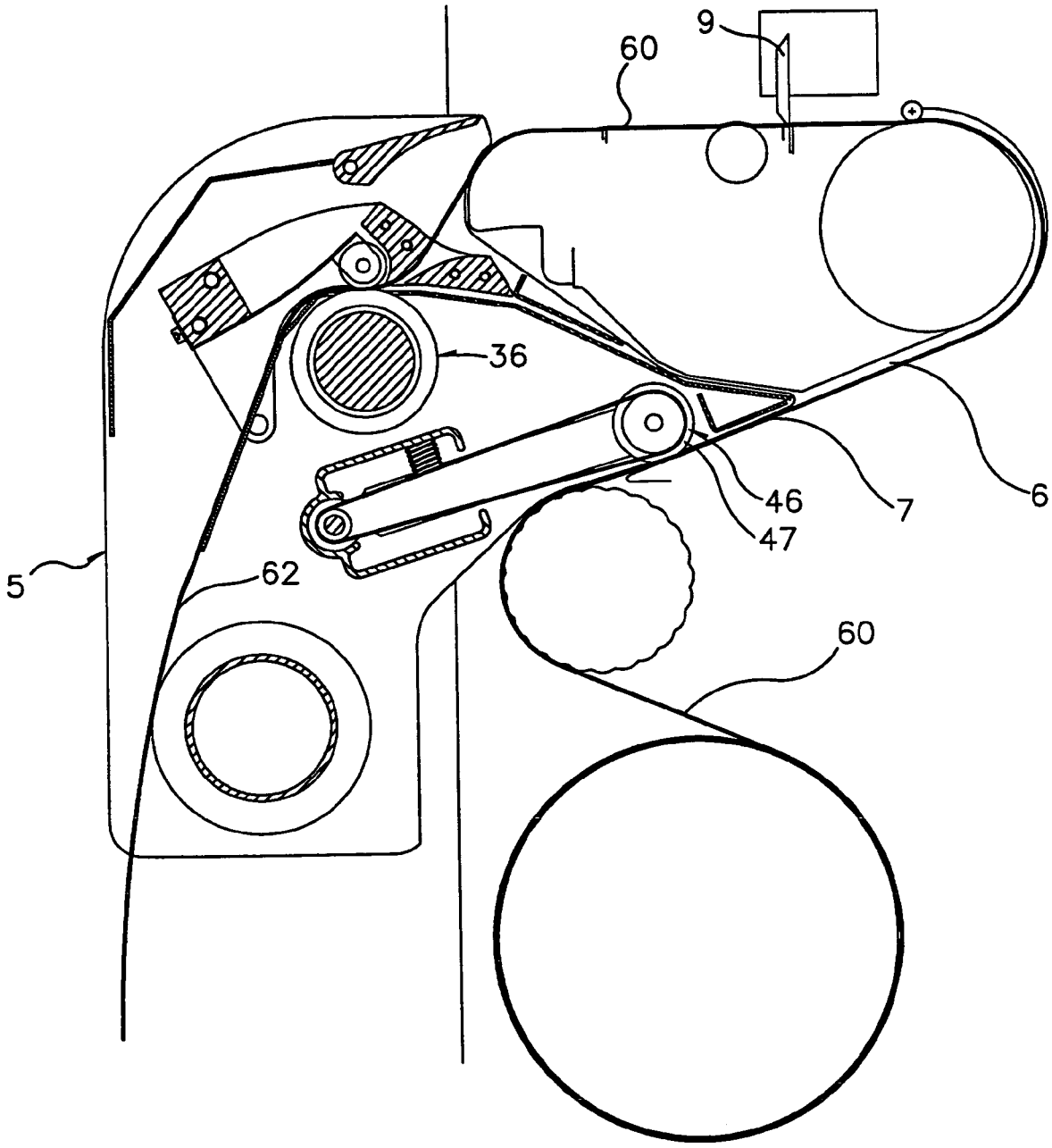

FIG. 9 illustrates the situation in which the web of paper 60 or the sheet not yet cut off has reached the final position and is ready to be cut off. After a suitable period for the final drying of the just printed sheet, the second guide means 21 is moved into its second position, cf. FIG. 9. In this position of the second guide means 21, the idler rollers 33 press by a suitable biasing ensured by the springs 34 against the surface of the first driving roller means 36 at the slot or the slots 41 in the guide plate 42. As a result, the web of paper 60 is pressed against the first driving roller means 36 at the same time as the adjacent guide rod 22 presses against said web of paper 60. In this manner the distance is determined between the squeezing location between the idler rollers 33 and the first driving roller means 36 and forward to suitable locations inside the printer, such as at the location where the cutting means 9, cf. FIG. 10, subsequently cuts the web of paper 60 and cuts off a suitable sheet 62. Prior to the cutting, the cam disk 18 also initiates a lowering of the second driving roller means 46 into abutment against the web of paper 60 on the paper-supporting plate 7 immediately outside the inlet of the printer 6, cf. FIG. 10. Before the cutting is initiated, the rollers 37 of the first driving roller means 36 are rotated clockwise over a small controlled angle so as to remove the tension in the paper between the printer and the apparatus 5.

Subsequently, the web of paper 60 is cut and a sheet 62 is formed.

Figure 11:
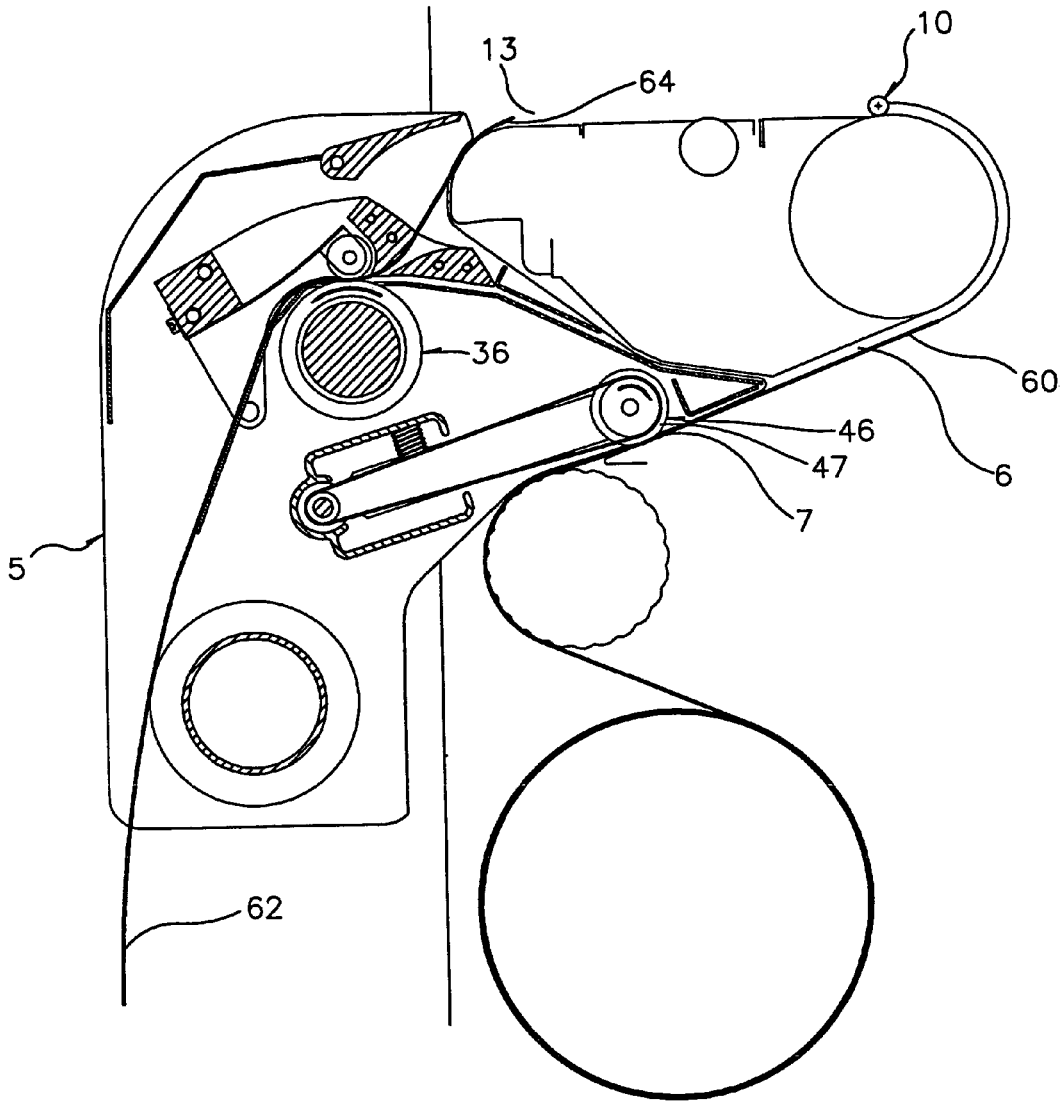
Figure 12:
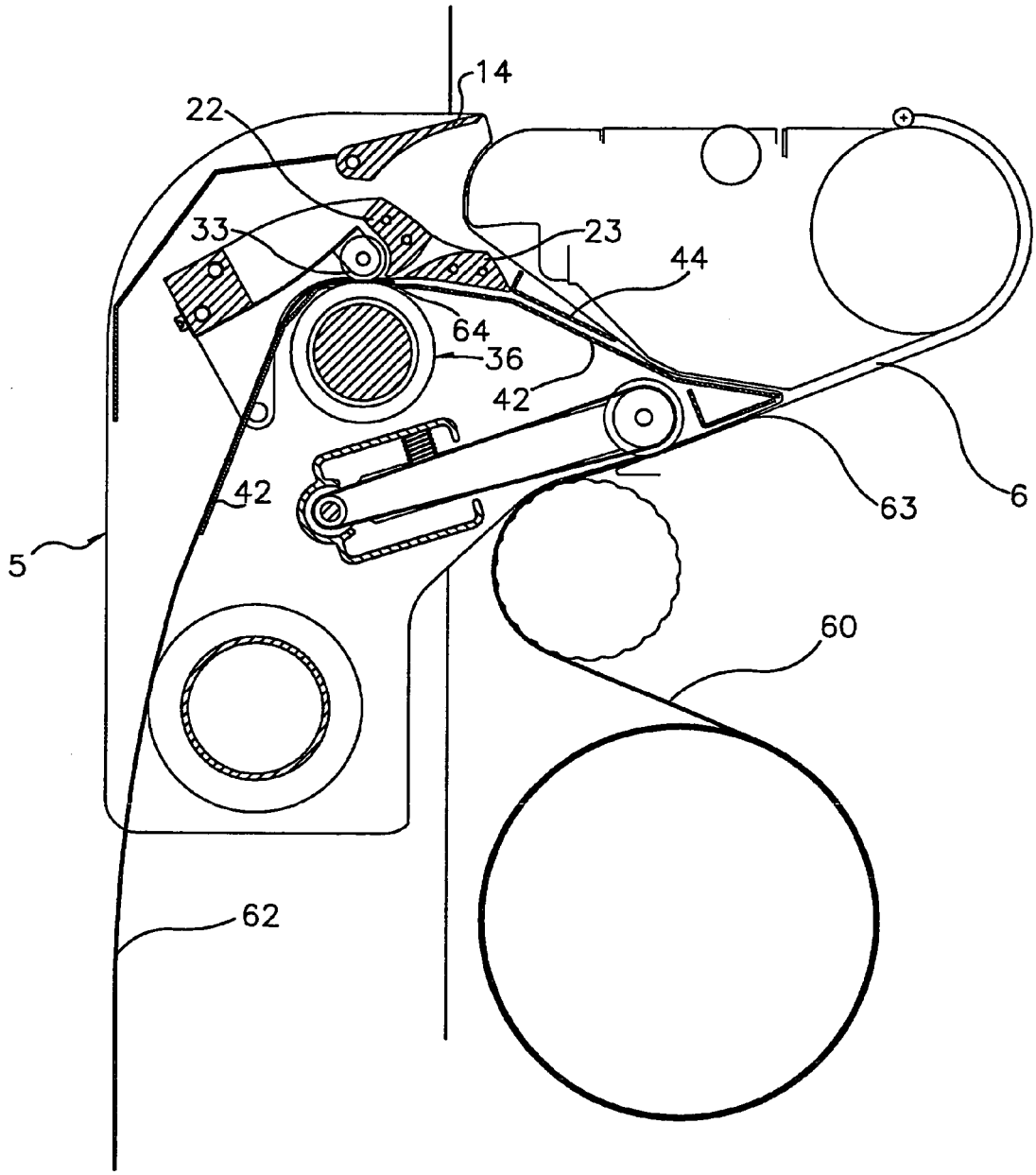

In FIG. 11 the sheet 62 is about to be moved further into the apparatus 5 by means of the first driving roller means 36 which is turned counterclockwise, cf. the arrow. In addition, the web of paper 60 is about to be moved backwards out of the inlet 6 of the printer by means of the second driving roller means 46, and the rollers 47 of said second driving roller means 47 are now rotated clockwise. The web of paper 60 can initially be moved backwards by means of the advancing mechanisms 10 of the printer. In order to facilitate the moving backwards of the web of paper 60, the paper-supporting plate 7 is as mentioned suitably provided with a coating, such as Teflon, which removes or at least minimizes the friction against the supporting plate 7. The moving backwards of the web of paper 60 is stopped, cf. FIG. 12, when the new front end 63 of said web of paper is positioned further out of the printer relative to the inlet 6 than the location at which the slot 44 between the printer and the guide plate 42 ends in the inlet 6. Now the sheet 62 has been moved so far into the apparatus 5 that the rearmost end 64 has been pressed into a substantially horizontal position due to the idler rollers 33 and the adjacent guide rod 22 and the mutual position of said idler rollers and said guide rod 22. The horizontal position of the rearmost end 64 implies that when the rotating direction of the first driving roller means 36 is turned, cf. FIG. 13, then said rearmost end 64 is guided into the slot 44 which is defined between the second guide rod 23 and the guide plate 42 at this location inside the apparatus.

Figure 13:
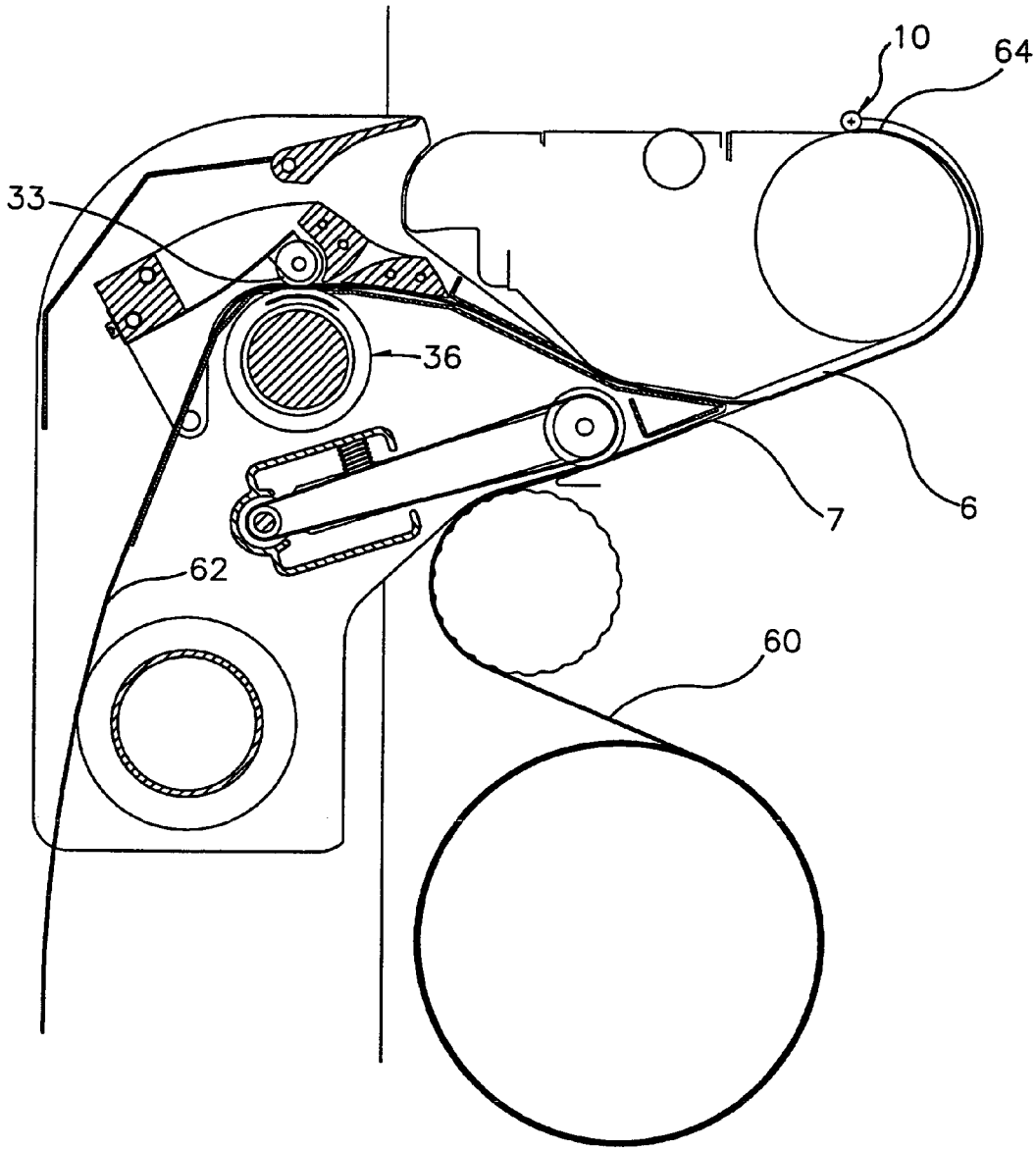

In FIG. 13, the sheet 62 has been moved all the way back to the advancing mechanisms of the printer through the inlet 6 of said printer. Suitable sensors and guide means inside both the apparatus 5 and the printer ensure that the printer knows when the end 64 now in front of the sheet 62 reaches the advancing mechanisms 10 and the length of said sheet 62 between the advancing mechanisms 10 and the squeezing location between the first driving roller means 36 and the resilient idler rollers 33. Thus the printing of the rear side of the sheet can be carried out in an exact manner relative to the printing on the front of said sheet.

Figure 14:
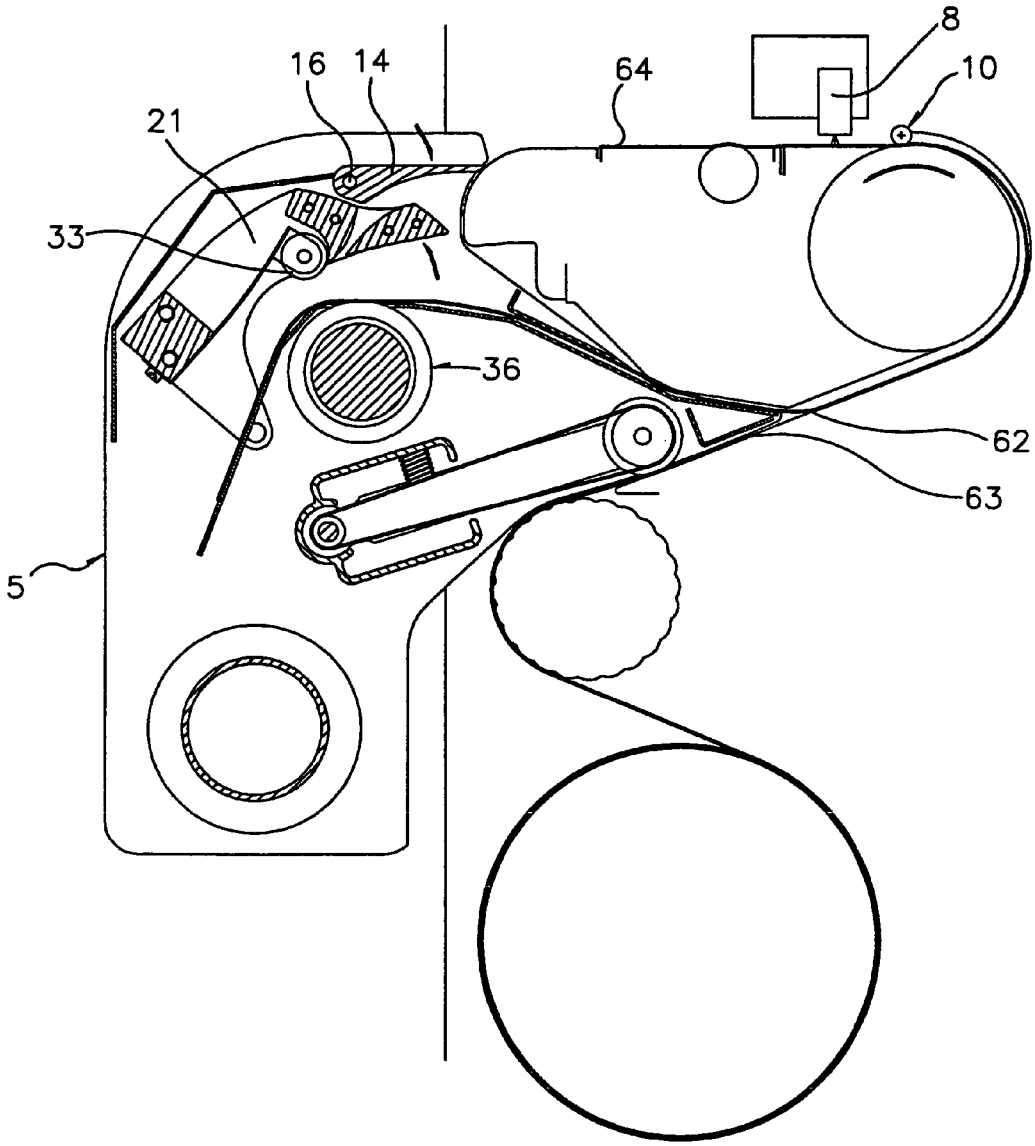

In FIG. 14, the advancing mechanisms 10 of the printer have taken over the advancing of the sheet 62. Here the first guide means 14 has in advance been returned to the position in which the opening into the apparatus 5 is closed. In addition, the second guide means 21 has been turned backwards counterclockwise and into the position in which it is ready to receive a new sheet. Thus the retaining engagement of the sheet 62 between the first driving roller means 36 and the idler rollers 33 has been released. During the continued advancing of the sheet 62, said sheet 62 is applied a suitable print by means of the printing means 8. The position of the first guide means 14 ensures that the sheet 62 is moved with the front end round the apparatus 5 and further to a collection box in a conventionally known manner.

Figure 15:
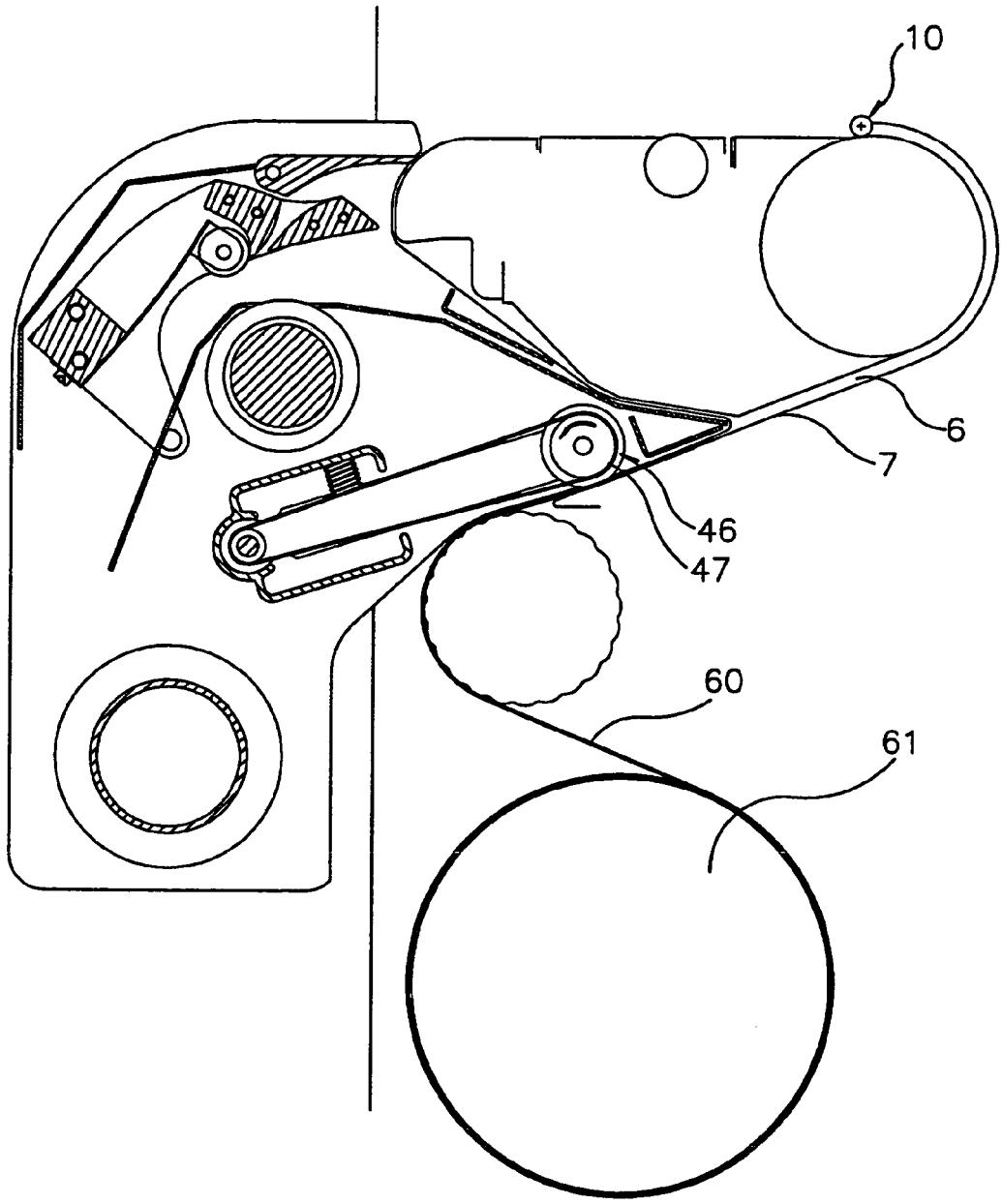
Figure 16:
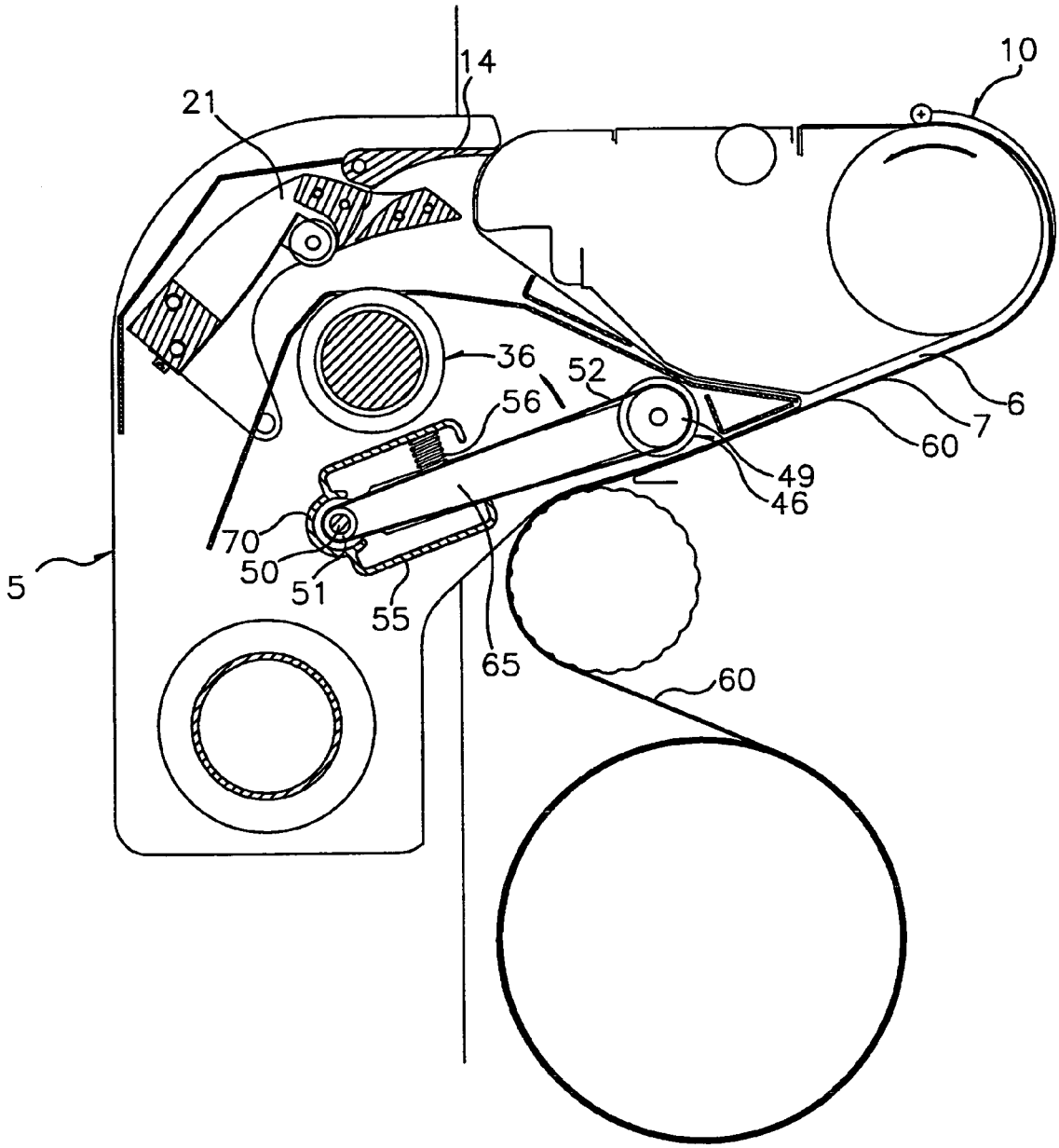

As illustrated in FIG. 15, the second driving roller means 46 is subsequently activated in such a manner that the rollers 47 thereof are now rotated counterclockwise. As a result, the web of paper 60 is returned to the printer and advanced to the advancing mechanisms 10 thereof. Suitable sensors imply that the appearance of the front end of the web of paper 60 to the advancing mechanisms 10 and the further advancing by means thereof can be carried out on the basis of an exact knowledge of various distances from the edges of the sheet and the position of the printing means. When the advancing mechanisms 10 take over the advancing of the web of paper 60, the second driving roller means 46 is caused to disengage said web of paper 60, cf. FIG. 16, by an activation of the release means 55 by means of the cam disk 18, cf. FIG. 3. As a result, the printer and the apparatus 5 are again in the state shown in FIG. 5 in which another printing procedure can be initiated. When only one side of the web of paper 60 is to be printed, the first guide means 14 remains in the position shown in FIGS. 5 and 16. When both sides of a sheet is to be printed, the first guide means 14 is moved upwards into the position shown in FIG. 6 in which it is ready to receive and invert said sheet.

Figure 17:
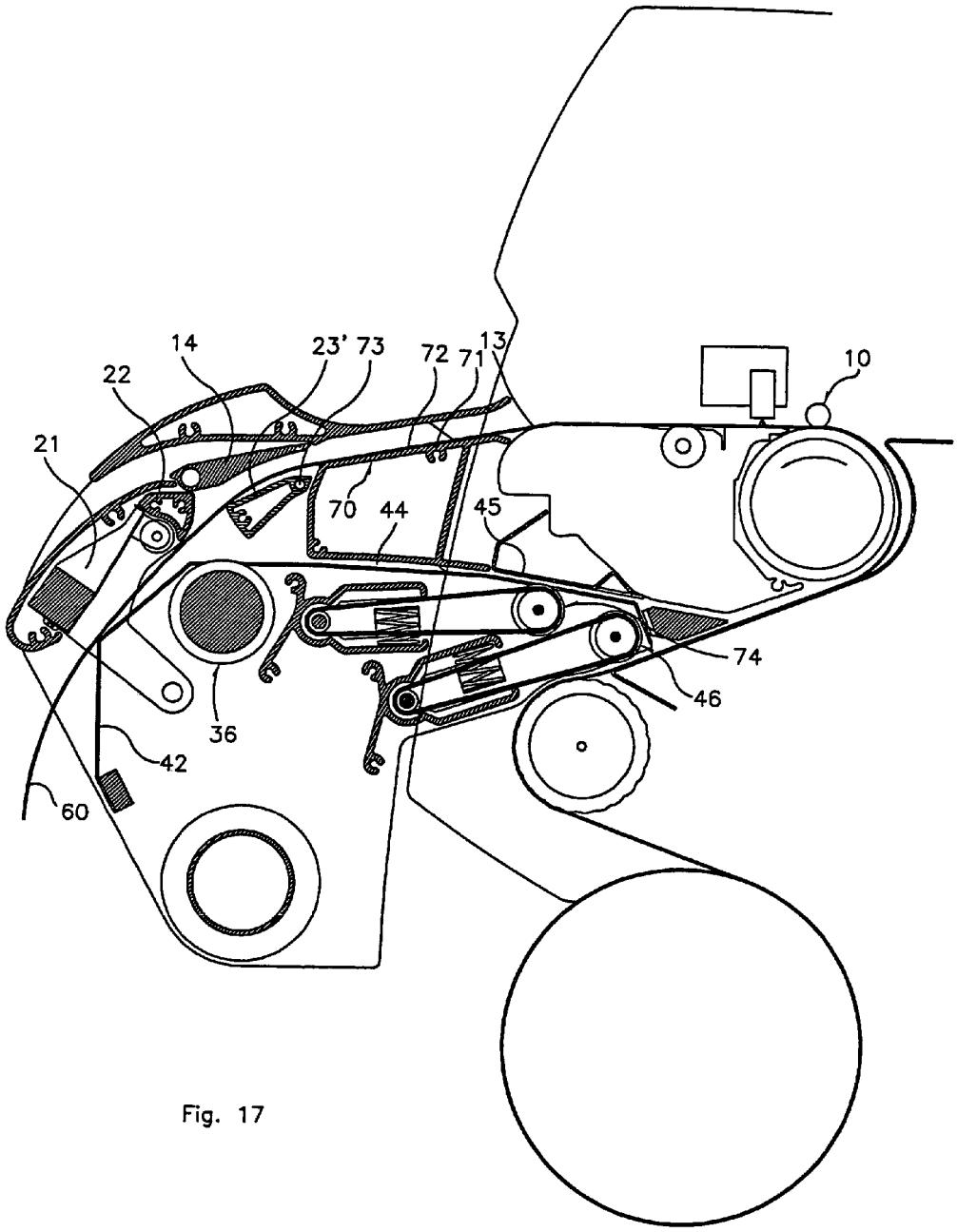
FIG. 17 illustrates a second embodiment of the apparatus according to the invention with the front end of a web of paper moved into said apparatus, FIG. 18 corresponds to FIG. 17, but where the sheet inside the apparatus is squeezed between a second guide means and a first driving roller means, and FIG. 19 corresponds to FIG. 18, but where the sheet passes through the printer and is about to be printed on the back while the first guide means is moved into a position in which the inlet of the apparatus according to the invention is blocked, whereas the second guide means is moved into a first position in which it is ready to receive a new sheet optionally to be inverted.
Figure 18:
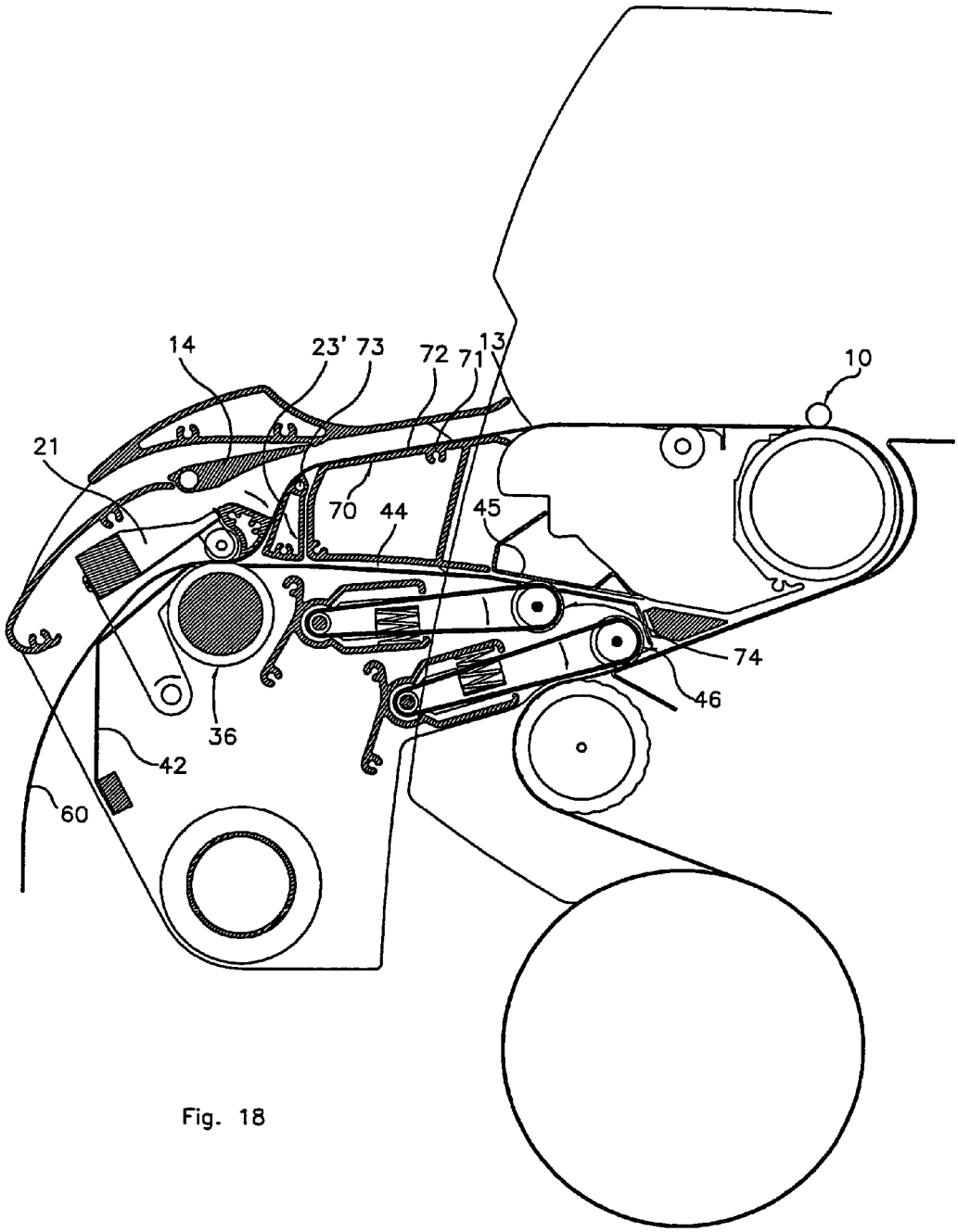
Figure 19:
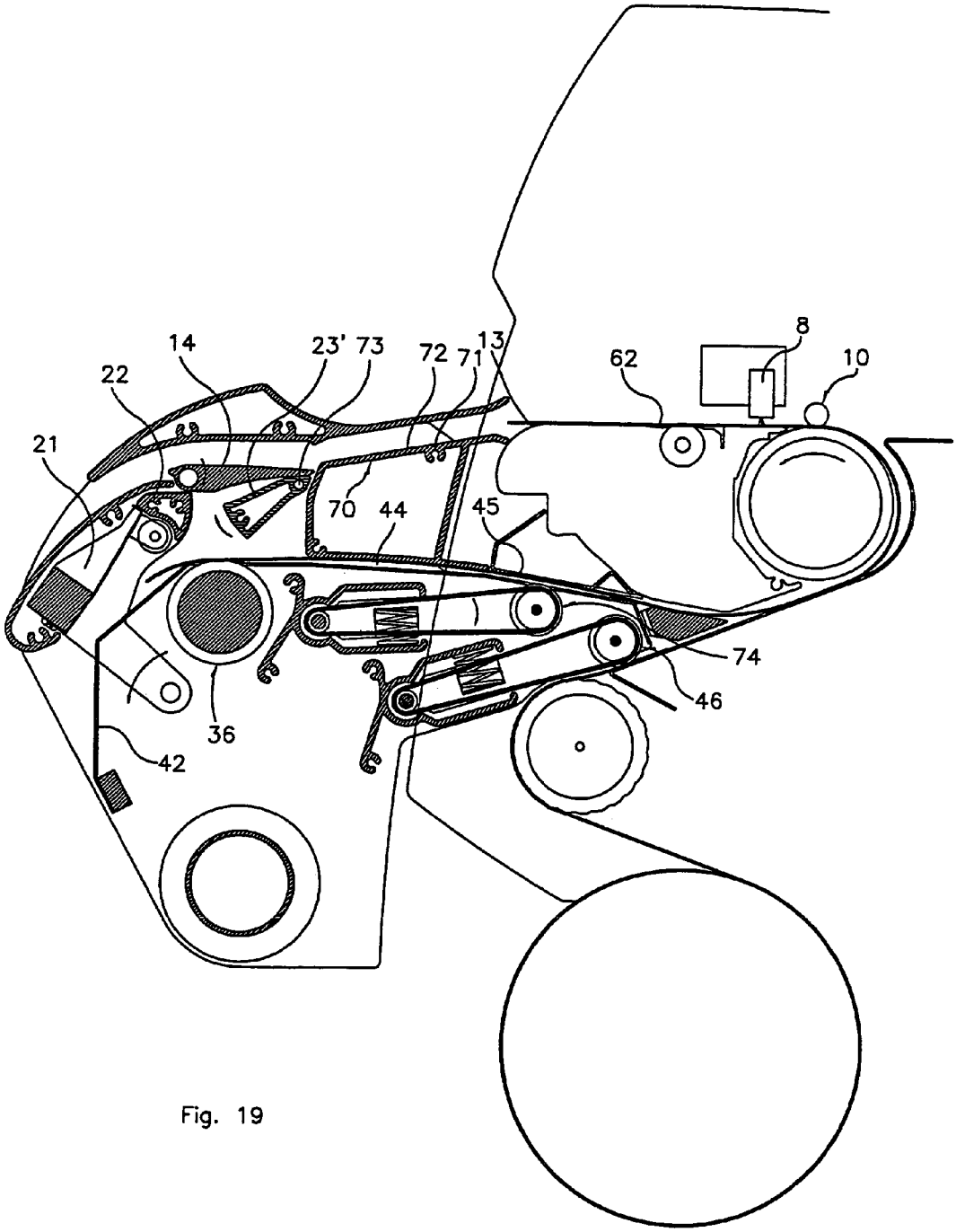

FIGS. 17 to 19 show a second embodiment of the apparatus according to the invention. In these Figures, the same reference numeral is used as above in connection with the mating parts. In this second embodiment, the apparatus comprises a transverse sectional beam designated the general reference numeral 70. The transverse sectional beam 70 is arranged such that in use it comprises a top side 71 forming a guiding surface 72 between the outlet 13 of the printer and the first guide means 14. The second guide means 21 is completely identical with the second guide means of the embodiment shown in FIGS. 1 to 16 apart from the fact that the guide rod 23' closest to the printer is separately mounted in the apparatus, said guide rod 23' being pivotal by means of a shaft 73 between two use positions, viz. the position shown in FIGS. 17 and 19 and the position shown in FIG. 18. In a manner not described in greater detail, the guide rod 23' is driven synchronously with the movement of the remaining portion of the second guide means 21.

The bottom side of the beam 70 and the guide plate 42 form a portion of the slot 44 extending to the printer. As the slot 44 of this embodiment is longer than the slot 44 of the embodiment shown in FIGS. 1 to 16, an additional third driving roller means designated the general reference numeral 74 is provided, said third driving roller means being completely identical with the second driving roller means 46. The third driving roller means 74 is adapted to co-operate with the guide plate 45 so as together with the first driving roller means 46 to move the sheet 62 back to the printer until the advancing mechanisms 10 of said printer can take over the advancing of said sheet 62.

As illustrated, the described embodiments of the apparatus are in form of separate units which can be coupled to existing printers. It is, of course, also possible to mount the apparatus in connection with the manufacture of new printers. The apparatus dealt with is as mentioned suited for use in connection with a specific type of printers, but it can, of course, also be used for other types of printers encumbered with the limitation that the feeding of sheets can only be carried out through the same inlet as a web of paper, and where the printed sheet leaves through a separate outlet. The control unit of the printer must, of course, be adjusted to the operation of the apparatus in such a manner that all the described steps can be automated.

The invention has been described with reference to preferred embodiments. Many modifications can be carried out without thereby deviating from the scope of the invention. The second guide means 21 can for instance be resiliently mounted in connection with the shaft 25, and the idler rollers 33 can be replaced by a fixed plate presenting a low coefficient of friction. In addition, the mounting and driving of the second and third roller means 46 can be carried out in many other ways than the one described here.

The invention claimed is:

1. An apparatus for receiving, inverting and returning sheets (62) from and to a printer (1) for large-sized paper, said printer being adapted to be automatically fed a web of paper (60) from a supply of paper (61) through an inlet (6) of said printer, defined by a portion of a paper-supporting plate (7), where said printer further is adapted to print and cut sheets (62) of said web of paper and to guide the printed and cut sheets (62) out of said printer through a separate outlet (13) and into said apparatus, where the apparatus is positioned at the inlet and the outlet of said printer, and is adapted to receive the printed and cut sheets (62) from said outlet and to return said printed and cut sheets to the printer in an inverted state, said apparatus comprising a pivoting first guide means (14) which in one position guides the printed and cut sheets (62) into the apparatus and in a second position guides said printed and cut sheets past said apparatus to be discharged from said printer, wherein the apparatus comprises a first driving roller means (36) and a second guide means(21) pivotally arranged relative to said roller means, where the second guide in a first position guides the printed and cut sheets (62) advanced into the apparatus round the first driving roller means (36) during the initial movement of the printed and cut sheets (62) into the apparatus, and where said second guide means in a second position presses said printed and cut sheets (62) into a driving engagement with the first driving roller means (36) in such a manner that said first driving roller means takes over driving of the printed and cut sheets (62) both during the remaining movement of said printed and cut sheets (62) inside the apparatus as well as during movement of said printed and cut sheets out of said apparatus again and into the printer through the inlet (6) of said printer while the direction of rotation is inverted, and wherein the apparatus comprises a second driving roller means (46) adapted to engage a portion of the web of paper (60) left on the paper-supporting plate (7) after the printed sheet (62) has been cut off and to pull said portion temporarily backwards towards the supply of paper (61) while the printed and cut sheet is being inverted so that said printed and cut sheet (62) can be guided into the printer without colliding with the web of paper (60).

2. An apparatus according to claim 1, wherein the second guide means (21) comprises an idler roller means (33) enabling the second guide means (21) to press the printed and cut sheet (62) against the first driving roller means (36), said idler roller means being biased in such a maimer that it presses against said first driving roller means (36) by a biasing.

3. An apparatus according to claim 2, wherein the second guide means (21) comprises a catching slot (28) for catching a front end of a printed and cut sheet (62) leaving the outlet (13) of the printer.

4. An apparatus according to claim 3, wherein the catching slot (28) is defined by a first and a second guide rod (22, 23), said first and second guide rods being substantially parallel and supported at each end by their respective arms (24) which are pivotally journalled about an axis of rotation extending parallel to said first and second guide rods (22, 23) and to the axis of rotation of the first driving roller means (36), where said first-mentioned axis of rotation forms the axis of rotation about which the second guide means (21) is rotating, and wherein said first and second guide rods (22, 23) comprise respective slot-defining surfaces (29, 30) which oppose one another on their respective sides of a guide plane (27) which includes the axis of rotation of the arms (24) and extends substantially freely in an upwardly inclining direction through the catching slot (28), and wherein said guide plane (27) in the first position of the second guide means (21) extends obliquely upwards towards the outlet (13) of the printer from the axis of rotation of the arms and substantially tangential to the first driving roller means (36), said latter axis of rotation being positioned on the side of the first driving roller means which opposes the printer and is on a level of a lower side of the first driving roller means (36), and wherein said guide plane (27) intersects the first driving roller means (36) in the second position of the second guide means (21).

5. An apparatus according to claim 4, wherein the idler roller means (33) is positioned on the same side as the first guide rod (22) when seen relative to the above guide plane (27), relative to which said first guide rod (22) is placed on the side opposite the axis of rotation of the first driving roller means (36) when the second guide means (21) is in its first position, wherein the idler roller means (33) are also positioned at a larger distance from said guide plane (27) than the adjacent area of the slot-defining surface (29) of the adjacent guide rod (22), and wherein the slot-defining surface (30) of the second guide rod (23) comprises an edge (32) placed close to the axis of rotation of the second guide means (21), said edge (32) being positioned at a larger distance from said axis of rotation than the corresponding edge (31) on the first guide rod (22).

6. An apparatus according to claim 4, wherein a width of the catching slot (28) increases in a direction radially away from the associated axis of rotation, whereby the angle between the planes being tangent to the slot-defining surfaces (29, 30) and said guide plane (27) increases in said direction and mostly along the surface of the second rod (23).

7. An apparatus according to claim 2, wherein a sheet-supporting plate (42) is provided on each side of an engaging area between the idler roller means (33) and the first driving roller means (36), said sheet-supporting plate (42) extending to an area adjacent the paper-supporting plate (7) of the printer on the side of the second driving roller means (46) which is positioned adjacent the printer inlet (6).

8. An apparatus according to claim 1, wherein the second driving roller means (46) comprises a plurality of rollers (47), where each of said plurality of rollers is rotatably arranged about a shaft (50) supported at one end by a pair of supporting arms (65), which in turn are rotatably arranged at an opposite end about an axis of rotation common to all the supporting arms (65) in such a manner that the plurality of rollers (47) can swing to an from in a direction away from the paper-supporting plate (7), and wherein the plurality of rollers (47) are supported and subjected to a biasing force in a direction towards said paper-supporting plate (7).

9. An apparatus according to claim 8, wherein the plurality of rollers (47) are driven by means of belt drives comprising their respective driving pulleys (51), which are arranged coaxially to the common axis of rotation of the supporting arms (65) and which are driven by means of a common actuating means (54), said belt drives further comprising a driven pulley (49) fixedly connected to the roller (47) in question.

10. An apparatus according to claim 8, wherein a release means (55) is provided which is adapted to simultaneously move all of the plurality of rollers (47) away from the paper-supporting plate (7).

* * * * *